United States Patent [19]

Zinna

[11] 4,030,563

[45] June 21, 1977

[54] SPEAKER SYSTEM OF CUBIC CONFIGURATION

[76] Inventor: Edward F. Zinna, 244 Bay 13th St., Brooklyn, N.Y. 11214

[22] Filed: Sept. 16, 1976

[21] Appl. No.: 723,723

[52] U.S. Cl. ..... 181/147; 181/154; 181/199

[51] Int. Cl.[2] ..... H04R 1/40

[58] Field of Search ..... 179/1 E, 1 GA; 181/144, 181/145, 146, 147, 154, 199

*Primary Examiner*—George G. Stellar
*Attorney, Agent, or Firm*—Charles E. Baxley

[57] ABSTRACT

Four speakers, each having a small thickness, are arranged so as to form a cubic arrangement. The four speakers form the four side surfaces of the cubic arrangement, with each of two diametrically opposed speakers extending at an acute angle relative to a vertical plane perpendicular to the other two speakers. A top panel connects the top edge surfaces of the speakers and has thereon means for attaching the system to a ceiling, or the like. In a modification of the invention, the speaker system is surrounded by a decorative housing having a top and bottom circular surface connected by four decorative posts. The four posts lie adjacent to the four corner edges of the cubic configuration. A grill cloth surrounds the front faces of the speakers for decorative and acoustical functions.

10 Claims, 4 Drawing Figures

SPEAKER SYSTEM OF CUBIC CONFIGURATION

SUMMARY OF THE INVENTION

The present invention is directed to a system of speakers for use in the home or office, and has as its specific aim a system that combines aesthetic design with functional efficiency.

The present invention is comprised of four speakers formed into a cubic arrangement so that the four speakers form the four side surfaces of a cube. Two of the speakers are positioned at angle relative to the other two speakers so that two diametrically opposed speakers face downwardly toward the floor when the speaker system is hung from a ceiling. The top edge surfaces of the four speakers are connected by a top panel or cover surface which has mounted thereon means for attaching the entire system to a ceiling, or the like. The speaker system may also be supported on a table or other flat surface by the bottom edge surfaces of the four speakers, which together act as support legs. The wiring of each speaker is brought out from the interior of the cubic configuration via a small opening between the top panel and one top edge surface of a speaker and are connected to an amplifier in the conventional manner.

In a modification of the invention, the speaker system is surrounded by a housing having a top and a bottom circular surface which are joined together by four decorative posts. The four posts are positioned adjacent to the four corner edges of the speaker system, where the speakers extend at right angles to each other. The top and bottom circular surfaces of the housing are of such a diameter as to extend beyond the outermost vertical planes of the speakers of the system so that aesthetic as well as support characteristics are achieved. A grill cloth, or other netting surrounds the speakers of the system, the color of the cloth being of similar shade and tone as that of the housing. The four posts extend beyond the top and bottom circular surfaces so that they may support the structure on a table or other flat surface and at the same time allow for a decorative design. Also, the top and bottom surfaces of each speaker are covered with an insulation pad so to separate the top and bottom surfaces from the top and bottom circular surfaces of the housing, which is preferably made of wood.

BRIEF DESCRIPTION OF THE DRAWING

The invention will be more readily understood with reference to the following detailed description, when read in conjunction with the accompanying drawing, wherein.

DETAILED DESCRIPTION OF THE INVENTION

Figure 1:
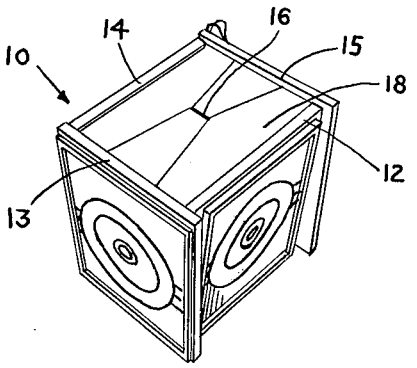
FIG. 1 is a top perspective view of the speaker system of the present invention.
Figure 2:
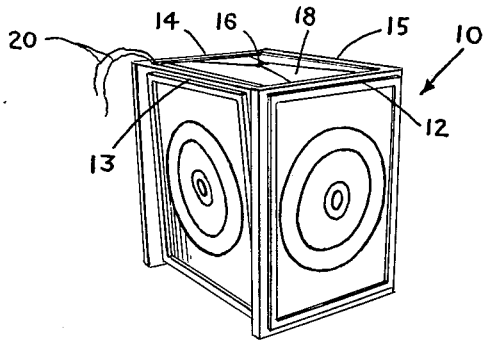
FIG. 2 is a side perspective view of the speaker system of the present invention.

Referring now to the drawing, there is shown in FIGS. 1 and 2 the speaker system 10 of the invention. The speaker system 10 is made up of four speakers 12, 13, 14 and 15 arranged as shown in the Figures so as to form a cube-shaped structure. Two of the speakers 13 and 15, which are positioned diametrically opposite each other, are mounted relative to the other two speakers 12 and 14 at an angle. As can be seen in FIG. 2 the speakers 13 and 15 extend at acute angles relative to vertical planes lying perpendicular to the speakers 12 and 14, the acute angle being taken in the counterclockwise sense from the vertical plane for speaker 13 and clockwise for speaker 15 so that the bottom edges of the speakers 13 and 14 are closer to each other than their respective top edges. Such an arrangement allows for the maximum diffusion of the sound emanating from the speaker system 10, since all areas of the room will be within the sphere of propagation of the sound waves.

The speakers 12, 13, 14 and 15 are well known and constitute on part of the present invention. Such speakers are preferably of very thin thickness so as to accommodate themselves readily to the arrangement shown. An example of the speakers used are those produced by Magitran, model P-40, which have a thickness of only 17/16 inches, and which have the power capability of 40 watts peak, 25 watts rms. It is, of course, to be understood that other speakers may be used as long as they are readily suitable to the configuration of the present invention. The speakers are typically made of a plastics material, such as polystyrene.

Figure 4:
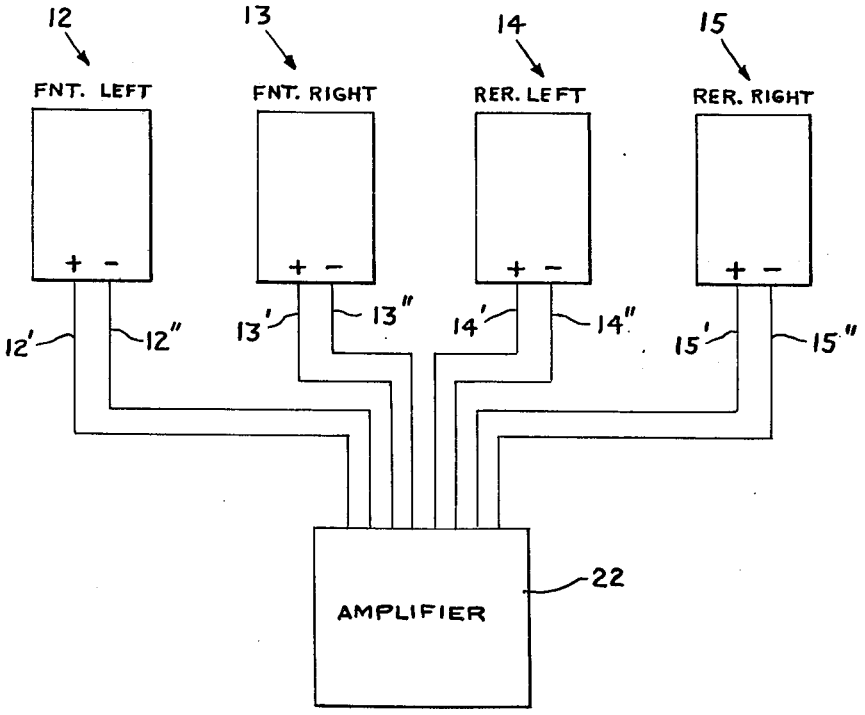
FIG. 4 is an electrical schematic showing the wiring connection of the speaker system of the present invention.

Connecting the top edge surfaces of the speakers 12, 13, 14 and 15 is a top panel 18 made of wood, cork, and the like, which serves to hold the speakers together, although it is to be understood that the edge surfaces of the speakers are glued, cemented, or otherwise attached to each other to form the shown configuration. The top panel 18 has mounted thereon a conventional wire attaching means 16 for supporting the speaker system 10 from a ceiling, or the like. Also, the speaker system 10 may be supported on a table, or other flat surface with the bottom edge surfaces of the speakers 12, 13, 14 and 15 serving as support legs for the arrangement. The top panel 18 is so dimensioned so as to allow for a space between an edge thereof and one of the top edge surfaces of one of the speakers so that the wiring 20 of the speakers may be brought out and connected to a suitable source. FIG. 4 shows the electrical wiring connection of the speaker system of the invention where the speakers 12, 13, 14 and 15 have their respective leads 12′, 12″, 13′, 13″, 14′, –″, and 15′, 15″ connected to a conventional amplifier 22.

Figure 3:
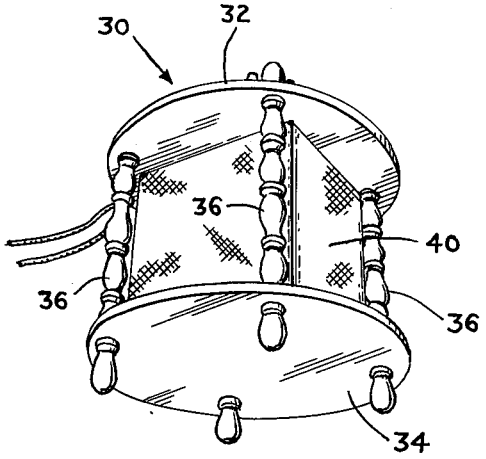
FIG. 3 is a bottom perspective view of a modification of the invention in which a housing is provided for the speaker system of FIGS. 1 and 2.

FIG. 3 shows an embodiment of the invention where the speaker system 10 is surrounded by a decorative housing 30. The housing 30 has a top circular surface 32 mounted above the top panel 18, and a bottom circular surface 34 mounted below the bottom edge surfaces of the speakers 12, 13, 14 and 15. The top and bottom circular surfaces 32 and 34 are connected together by four decorative posts 36 (only three being shown). The four decorative posts 36 mount the top and bottom circular surfaces and thereby support the speaker system 10. Suitable and conventional attaching means may be provided on the top portion of the top circular surface 32 in order to allow for support of the entire structure from a ceiling, and the like. The four posts 36 are positioned directly adjacent the four corner edges of the speaker system 10 where the edge surfaces of one speaker meets the end surface of an adjacent speaker. The top and bottom circular surfaces 32 and 34 are of such a diameter that the speaker system 10 lies entirely within the extent of the top and bottom circular surfaces, as can be seen from FIG. 3. A grill cloth 40, or other netting, is wrapped or otherwise mounted about the front faces of the four speakers 12, 13, 14 and 15 in order to serve an aesthetic as well as acoustical function.

FIG. 3 also shows that the four posts 36 extend beyond the top and bottom circular surfaces 32 and 34 for decorative purposes and for the purpose of allowing support of the structure on a table top or other flat surface.

The housing 30 is preferably made of wood for the aesthetics associated therewith, and for this reason it is preferable that an insulation pad be positioned between the top surfaces of each speaker 12, 13, 14 and 15 and the top circular surface 32, and between the bottom surface of each speaker 12, 13, 14 and 15 and the bottom circular surface 34.

While a specific embodiment of the invention has been shown and described, it is to be understood that numerous changes and modifications may be made without departing from the scope and spirit of the invention.

What is claimed is:

1. A speaker system for use in the home or office, and which is designed for hanging from a ceiling or support on a flat surface such as a table, comprising: four speakers each having a thin thickness, said four speakers being arranged to form a cubic arrangement where each one of said speakers forms one of the four side surfaces of the cubic arrangement, two of said speakers lying diametrically opposed to one another and each being canted at an acute angle relative to a vertical plane perpendicular to the other two of said four speakers so that the bottom edge surfaces of said two speakers lie closer together than the top edge surfaces thereof; a top panel connecting the top edge surfaces of said four speakers; and means on said top panel for attaching said top panel to a ceiling or the like, whereby said two speakers face downwardly toward the floor when hung from a ceiling via said means for attaching and allow for a maximum efficiency of the system.

2. The speaker system according to claim 1, wherein said top panel is made of cork, and said means for attaching comprises a wire having a hook thereon.

3. The speaker system according to claim 2, wherein said top panel has an opening formed between an edge surface thereof and a top edge surface of one of said four speakers, whereby the wiring from said speakers are brought out via said opening.

4. The speaker system according to claim 1, further comprising a decorative housing for said frame, said housing comprising a top solid surface, a bottom solid surface, said top and bottom solid surfaces of said housing being mounted atop and beneath said top panel and said bottom edge surfaces of said four speakers, respectively, and a plurality of connecting posts mounted between said top and bottom solid surfaces of said housing outside of said cubic arrangement, each of said top and bottom solid surfaces of said housing having a span greater than said cubic arrangement so as to extend therebeyond on all sides thereof.

5. The speaker system according to claim 4, wherein each of said top and bottom solid surfaces of said housing is of circular shape and has a diameter greater than the length of a side of a speaker.

6. The speaker system according to claim 5, wherein each of said posts has a portion extending beyond said top and bottom solid of said housing, said four posts serving to mount said top and bottom solid surfaces about said four speakers.

7. The speaker system according to claim 6, wherein said four posts are positioned relative to said four speakers so that there is one post directly adjacent to a corner edge of said cubic arrangement formed by edge surfaces of said speakers meeting perpendicularly.

8. The speaker system according to claim 7, wherein said top solid surface of said housing comprises means for mounting said housing to a ceiling, or the like.

9. The speaker system according to claim 8, wherein said housing is made of wood, and further comprises a plurality of insulation pads for positioning between said top solid surface of said housing and the top edge surfaces of said four speakers, and between said bottom solid surface of said housing and the bottom edge surfaces of said four speakers, respectively.

10. The speaker system according to claim 9, further comprising a grill cloth surrounding the front surfaces of said four speakers, said grill cloth having a color matching with that of said housing.

* * * * *

UNITED STATES PATENT AND TRADEMARK OFFICE

CERTIFICATE OF CORRECTION

PATENT NO. : 4,030,563

DATED : June 21, 1977

INVENTOR(S) : Edward F. Zinna

It is certified that error appears in the above-identified patent and that said Letters Patent are hereby corrected as shown below:

In Column 2, line 18, before "part" delete [on] and insert no therefor.

In Column 2, line 23, delete [17/16] and insert 1-7/16 therefor.

In Column 2, line 48, after "14'," delete [-"] and insert 14" therefor.

Signed and Sealed this

*Eighth* Day of *November 1977*

[SEAL]

*Attest:*

RUTH C. MASON
*Attesting Officer*

LUTRELLE F. PARKER
*Acting Commissioner of Patents and Trademarks*